US005290040A

United States Patent [19]

Boroski

[11] Patent Number: 5,290,040

[45] Date of Patent: Mar. 1, 1994

[54] APPARATUS FOR A BALL TOSSING GAME

[76] Inventor: Stanley J. Boroski, RD #2 Valley View Box 92, Rayland, Ohio 43943

[21] Appl. No.: 990,037

[22] Filed: Dec. 14, 1992

[51] Int. Cl.[5] ..... A63B 67/00

[52] U.S. Cl. ..... 273/346; 273/400; 273/DIG. 30

[58] Field of Search ..... 273/400, 401, 402, 398, 273/399, 336, 342, 411, 424, 425, 58 A, DIG. 30

[56] References Cited

U.S. PATENT DOCUMENTS

| | | | |
|---|---|---|---|
| 922,717 | 5/1909 | Parker | 273/401 |
| 4,204,682 | 5/1980 | Brown | 273/401 |
| 4,804,192 | 2/1989 | Matsumoto et al. | 273/336 |
| 4,863,175 | 9/1989 | Ricks, Jr. et al. | 273/342 |
| 4,877,256 | 10/1989 | Falloon | 273/400 |
| 4,964,644 | 10/1990 | Hull et al. | 273/336 |
| 4,971,335 | 11/1990 | Galvin | 273/411 |
| 4,989,880 | 2/1991 | Gettemeier et al. | 273/336 |
| 5,026,054 | 6/1991 | Osher et al. | 273/58 A |
| 5,123,656 | 5/1992 | Green | 273/400 |

*Primary Examiner*—William H. Grieb
*Attorney, Agent, or Firm*—S. Michael Bender

[57] ABSTRACT

A new and improved apparatus for an object tossing game includes an object for tossing and a target assembly which includes a number of cylindrical cans and a base unit for supporting the cans. The tossed object can be a soft, lightweight, resilient ball. The base unit includes a floor and a semi-circular back board. Two cans are located relatively close to the back board and are assigned lower point values than one can that is located relatively far from the back board. A flexible, roll-up support surface is provided for supporting the target assembly. The support surface can include indicia which indicate a number of predetermined positions at which the target assembly can be placed, or at which a player can stand, on the support surface. The predetermined positions on the support surface are representative of different levels of difficulty for a player to successfully target a can in the target assembly. The support surface can be rolled up into a housing which includes a coiled spring which supplies the energy for rolling up the support surface. In an alternative embodiment, two target assemblies and two flexible, roll-up support surfaces are provided. Two coiled springs are provided in a housing for rolling up the two respective roll-up surfaces after the respective target assemblies have been removed from the surfaces.

6 Claims, 4 Drawing Sheets

TOSS A BALL
SCORE CARD

| | 1 | 2 | 3 | 4 | 5 | 6 | 7 | 8 | 9 | 10 | 11 | 12 | 13 | 14 | 15 | T |
|---|---|---|---|---|---|---|---|---|---|---|---|---|---|---|---|---|
| | | | | | | | | | | | | | | | | |
| | | | | | | | | | | | | | | | | |
| | | | | | | | | | | | | | | | | |
| | | | | | | | | | | | | | | | | |
| | | | | | | | | | | | | | | | | |
| | | | | | | | | | | | | | | | | |
| | | | | | | | | | | | | | | | | |
| | | | | | | | | | | | | | | | | |

APPARATUS FOR A BALL TOSSING GAME

BACKGROUND OF THE INVENTION

1. Field of the Invention

The present invention relates generally to games involving tossing an object to a target and more particularly, to a game involving accurately tossing a series of balls into an array of a plurality of target containers.

2. Description of the Prior Art

Games in which an object is tossed or thrown toward a target are well known. For example, the game of horseshoes involves tossing a horsehoe onto a stake driven into the ground. Making holes in the ground is an undesirable side effect of playing horseshoes. Horseshoes are heavy and pose a danger to a person who would inadvertently be hit by a tossed horseshoe. Moreover, certain susceptible persons would incur muscle strains in tossing the heavy horseshoes during a game.

As another example, the game of basketball involves tossing a ball through a hoop. The basketball is a relatively large and weighty object, and the hoop is installed at a relatively high location, often requiring large and weightly supports for the hoop.

Yet another example of a game in which objects are thrown or tossed at a target is the game of darts. Darts are inherently dangerous in view of their sharp, penetrating points. In general, it would be desirable if a game were provided in which an inherently harmless object were tossed or thrown to a target.

In addition to the games discussed above, some additional games are disclosed in the prior art patents cited below. U.S. Pat. No. 4,804,192 of Matsumoto et al discloses a game in which objects (rings or balls) are thrown at a moving target. In Matsumoto et al, the moving targets have complex mechanical oscillatory mechanisms.

U.S. Pat. No. 4,863,175 of Ricks et al discloses a game apparatus in which a target includes a scoring port that has a substantially horizontal portion disposed on a backboard assembly. The scoring port also includes an angled portion wherein the angled portion and the horizontal portion are joined along a common edge at an obtuse angle, preferably less than about 135 degrees. The ball is first bounced off of a playing surface before the ball lands in the scoring port.

U.S. Pat. No. 4,971,335 of Galvin discloses a toss ball game device that includes a cord which is fastened to two spaced apart support posts that are vertically mounted from the ground. An alarm is connected to the cord. The player may score a point by tossing a ball at the cord and hitting it. The alarm signals each point made. This game requires a large surface area to play and requires a plurality of holes to be made in the ground.

Thus, while the foregoing body of prior art indicates it to be well known to use targets for tossed objects in games, the prior art described above does not teach or suggest an apparatus for a ball tossing game which does not require making holes in the ground, which does not use heavy tossed objects, which does not pose a danger to a person who would inadvertently be hit by a tossed object, which will not cause susceptible persons to incur nuscle strains from tossing a heavy object, which does not require large and weighty supports for the target, and which does not require a large surface area to play the game.

The foregoing disadvantages are overcome by the unique apparatus for a ball tossing game of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved apparatus for an object tossing game which includes an object for tossing and a target assembly which includes a number of cylindrical cans and a base unit for supporting the cans. The tossed object can be a soft, lightweight, resilient ball. The base unit includes a floor and a semi-circular back board. Two cans are located relatively close to the back board and are assigned lower point values than one can that is located relatively far from the back board. A flexible, roll-up support surface is provided for supporting the target assembly. The support surface can include indicia which indicate a number of predetermined positions at which the target assembly can be placed, or a player can stand, on the support surface. The predetermined positions on the support surface are representative of different levels of difficulty for a player to successfully target a can in the target assembly with the tossed ball. The support surface can be rolled up into a housing which includes a coiled spring which supplies the energy for rolling up the support surface. The support surface can include a first member of a hook and pile connector; and the target assembly can include a second member of a hook and pile connector. In an alternative embodiment, two target assemblies and two flexible, roll-up support surfaces are provided. Two coiled springs are provided in a housing for rolling up the two respective roll-up surfaces after the respective target assemblies have been removed from the support surfaces.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved apparatus for a ball tossing game which has all of the advantages of the prior art and none of the disadvantages.

It is another object of the present invention to provide a new and improved apparatus for a ball tossing game which may be easily and efficiently manufactured and marketed.

It is a further object of the present invention to provide a new and improved apparatus for a ball tossing game which is of durable and reliable construction.

An even further object of the present invention is to provide a new and improved apparatus for a ball tossing game which is susceptible of a low cost of manufacture with regard to both materials and labor, and which accordingly is then susceptible of low prices of sale to the consuming public, thereby making such apparatus for a ball tossing game available to the buying public.

Still yet a further object of the present invention is to provide a new and improved apparatus for a ball tossing game which does not require making holes in the ground for supporting the target.

Still another object of the present invention is to provide a new and improved apparatus for a ball tossing game which does not require a heavy tossed object and which does not pose a danger to a person who would inadvertently be hit by a heavy tossed object.

Yet another object of the present invention is to provide a new and improved apparatus for a ball tossing game which does not subject certain susceptible persons to muscle strains in tossing a heavy object during a game.

Even another object of the present invention is to provide a new and improved apparatus for a ball tossing game which does not require a target to be located at a relatively high location and does not require large and weighty supports for the target.

Still a further object of the present invention is to provide a new and improved apparatus for a ball tossing game in which an inherently harmless object is tossed or thrown to a target.

Yet another object of the present invention is to provide a new and improved apparatus for a ball tossing game that does not require a large surface area to play the game.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
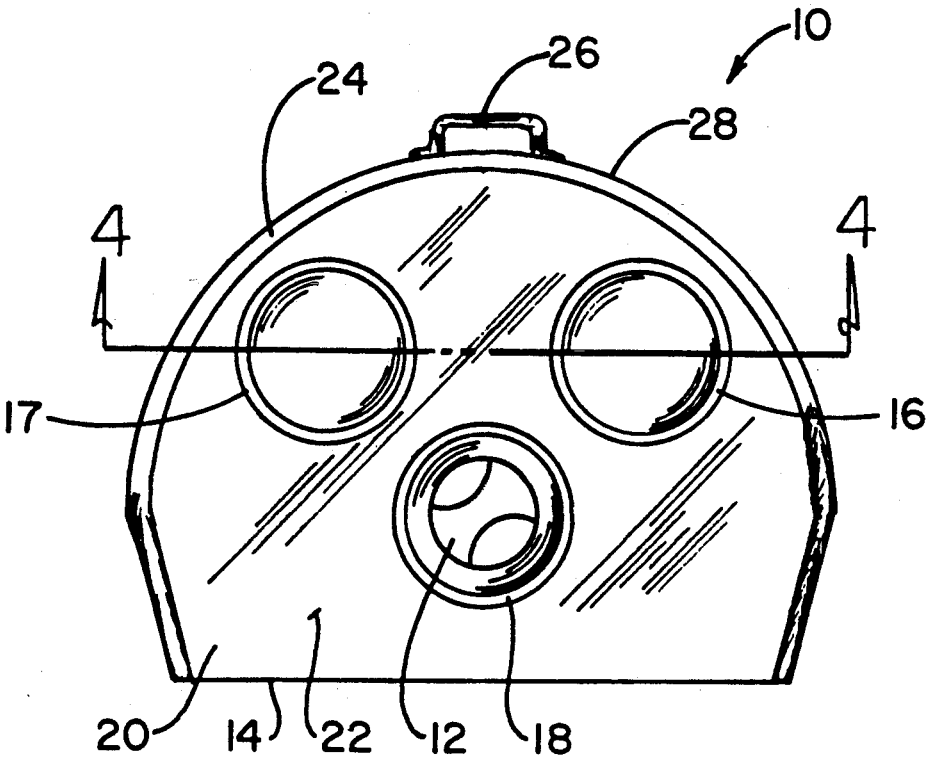
FIG. 1 is a plan view showing a first preferred embodiment of an apparatus for a ball tossing game of the invention.
Figure 2:
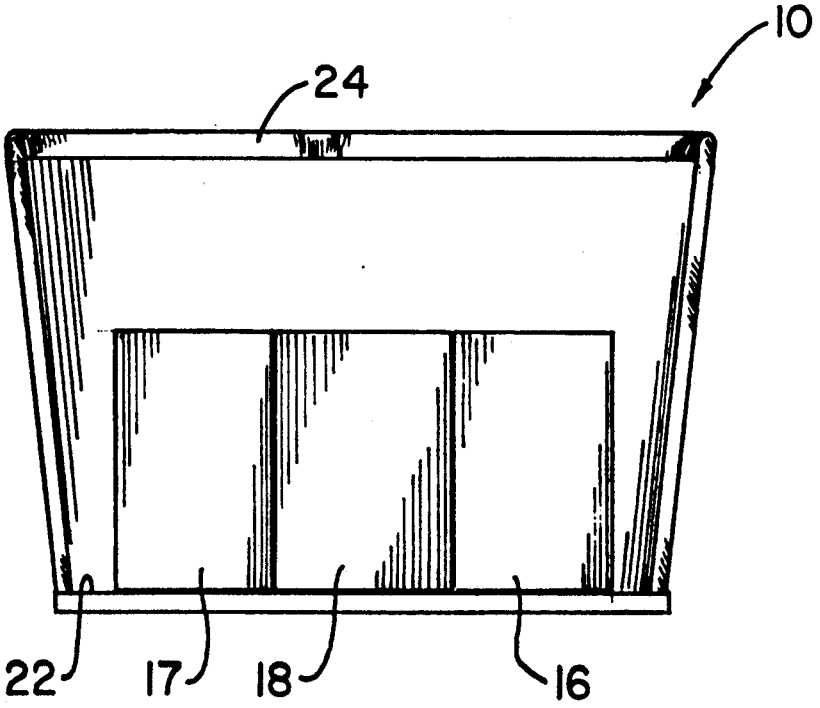
FIG. 2 is a front view of the apparatus for a ball tossing game of the invention shown in FIG. 1.
Figure 3:
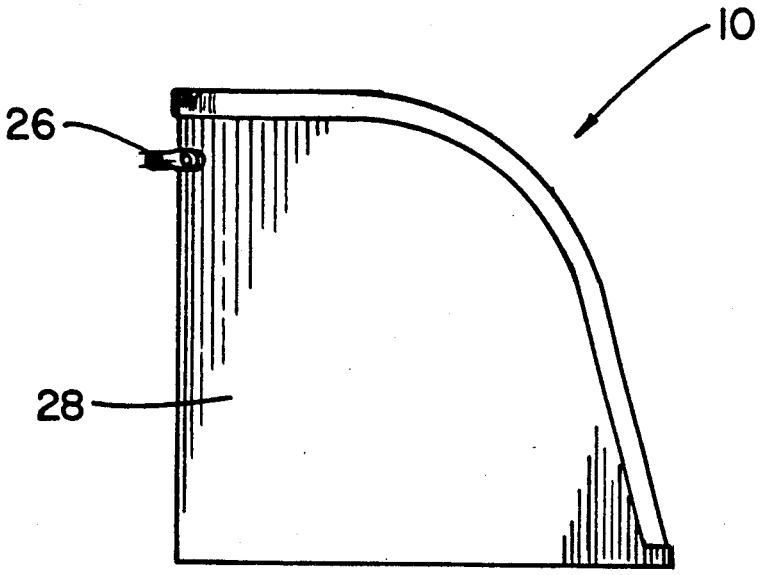
FIG. 3 is a side view of the apparatus for a ball tossing game of the invention shown in FIG. 1.

With reference to the drawings, a new and improved apparatus for a ball tossing game embodying the principles and concepts of the present invention will be described.

Turning initially to FIGS. 1–4, there is shown a first exemplary embodiment of the apparatus for a ball tossing game of the invention generally designated by reference numeral 10. In its preferred form, apparatus for a ball tossing game 10 includes an object (ball 12) for tossing to a target assembly 14 which receives the tossed ball 12. The target assembly 14 includes three target elements (cylindrical cans 16, 17, and 18) and a base unit 20 for supporting the cans 16, 17, and 18. Although not shown in the figures, the cans 16, 17, and 18 can be color coded and assigned different point values in the game.

The target assembly base unit 20 includes a floor portion 22 and a semicircular back board portion 24. Cans 16 and 17 are located relatively close to the back board portion 24, and can 18 is located relatively far from the back board portion 24. Cans 16 and 17 are assigned lower point values than the can 18. This is so because it is easier to get the ball 12 to land in cans 16 and 17 due to bouncing off of the back board portion 24 than it is to get the ball 12 to land directly into can 18 which is not near the back board portion 24. The cans 16, 17, and 18 and the base unit 20 may be formed as a unitary, integrated structure. A handle 26 is located on the back surface 28 of the back board portion 24 to enable easy carrying of the target assembly 14.

Figure 4:
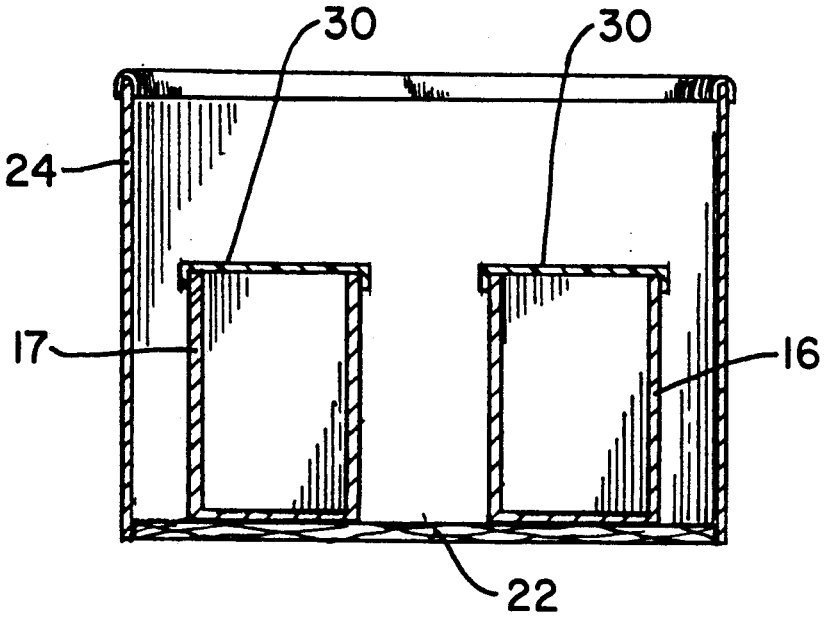
FIG. 4 is a cross-sectional view of the target assembly of the invention shown in FIG. 1 taken along the line 4—4 thereof.

To aid in transporting the apparatus for a ball tossing game 10 of the invention, balls 12 that are used with the invention can be stored in the cans 16, 17, and 18. In this respect, the cans 16, 17, and 18 can be provided with covers 30 (as shown in FIG. 4) to retain balls 12 in the cans 16, 17, and 18 during transport. The covers 30 can be tight-fitting plastic covers to fit tightly over the respective rims of the cans 16, 17, and 18.

Figures 5, 6, 7:
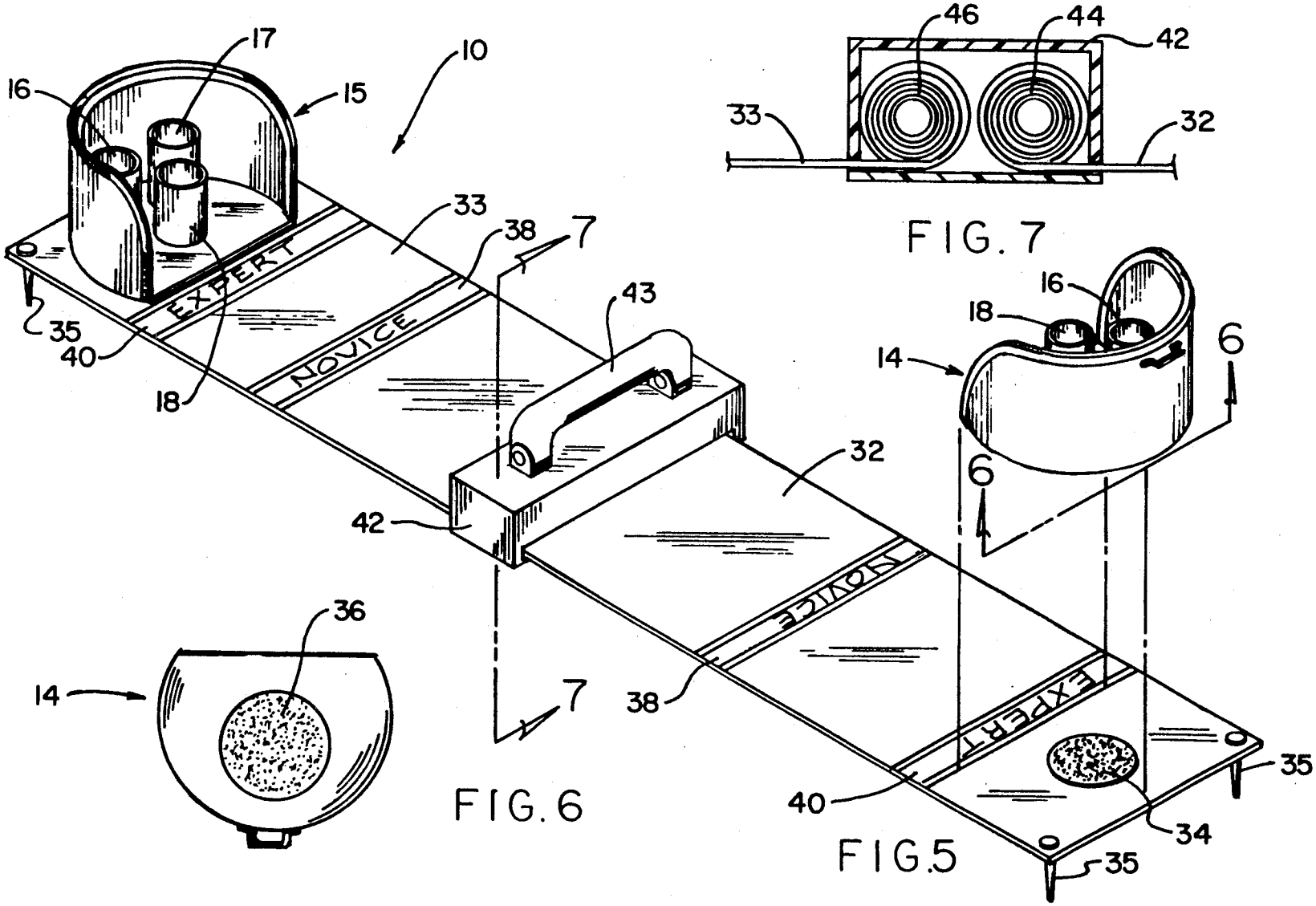
FIG. 5 is a partially exploded perspective view of a second embodiment of the apparatus for a ball tossing game of the invention.
FIG. 6 is a bottom view of a target assembly of the second embodiment of the apparatus for a ball tossing game of the invention shown in FIG. 5, taken along line 6—6 thereof.
FIG. 7 is a cross-sectional view of a housing in the second embodiment of the apparatus for a ball tossing game of the invention shown in FIG. 5, taken along the line 7—7.

Turning to FIGS. 5–7, a second embodiment of the apparatus for a ball tossing game 10 of the invention is shown. Reference numerals are shown that correspond to like reference numerals that designate like elements shown in the other figures. In addition, two support surfaces 32 and 33 are present for supporting the target assemblies 14 and 15, respectively. Short tacks 35 can be easily pushed into the ground through the corners of the two support surfaces 32 and 33 to prevent the corners from curling up.

The support surface 32 also includes a first member 34 of a hook and pile connector; and the target assembly 14 includes a second member 36 of a hook and pile connector. When the respective first member 34 and second member 36 of the hook and pile connectors are placed in contact, that is when the target assembly 14 is placed on the support surface 32, the two hook and pile members interconnect, thereby fastening the target assembly 14 to the support surface 32.

The support surfaces 32 and 33 include indicia indicating a number of predetermined positions 38 and 40 at which the respective target assemblies 14 and 15 can be placed on the respective support surfaces 32 and 33. In this regard, additional hook and pile members 36 (not shown) may appropriately be placed on the support surfaces 32 and 33 as will be evident to those of ordinary skill. Alternatively, players can stand at the predetermined positions 38 and 40. The predetermined indicated positions 38 and 40 of the target assemblies on the support surfaces are representative of different levels of difficulty (e.g. novice and expert) for successfully targeting a can among the cans 16, 17, and 18 in the respective target assemblies 14 and 15.

The support surfaces 32 and 33 are comprised of flexible sheets of durable material (e.g. made from plastic sheeting). A housing 42 is provided for retaining the respective flexible sheets 32 and 33 when they are rolled up for storage and for transporting them after the respective target assemblies 14 and 15 have been removed from the flexible sheets 32 and 33. Within the housing 42, a first coiled spring 44 is provided for rolling up flexible sheet 32. A second coiled spring 46 is provided for rolling up flexible sheet 33. The respective coiled springs can include latch mechanisms similar to the well known latch mechanisms used with window shades. A handle 43 is affixed to the topside of the housing 42 to enable easy transport of the housing 42 when the coiled springs 44 and 46 have rolled up the respective flexible sheets 32 and 33 into the housing 42.

Figures 8, 9:
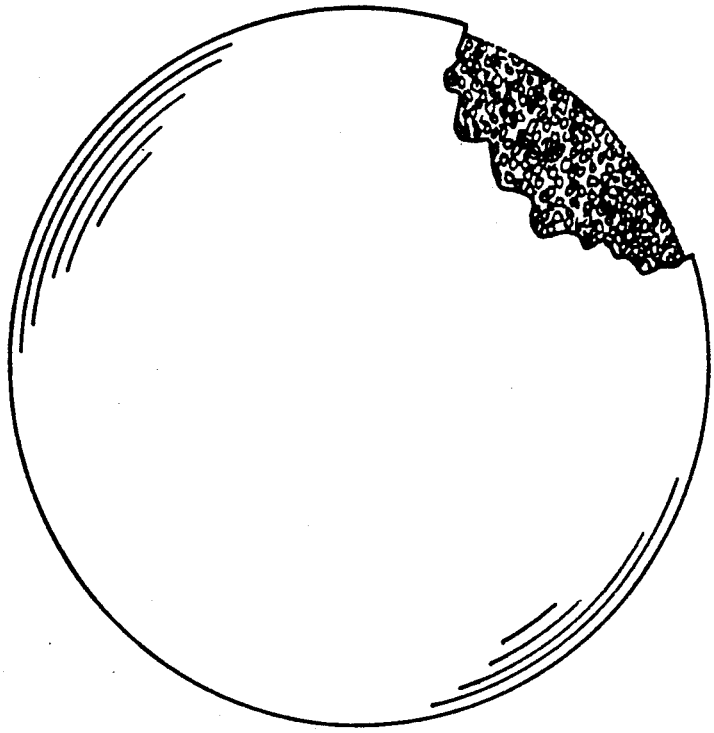
FIG. 8 represents a score card that can be used when playing a game using the apparatus for a ball tossing game of the invention shown in either FIG. 1 or FIG. 5.
FIG. 9 is a side view of an alternate soft, resilient, lightweight ball that can be used as the object being tossed with the apparatus for a ball tossing game of the invention shown in FIG. 1 or FIG. 5.

In FIG. 8, a sample of a score card 50, that can be used in playing a game when using an apparatus of the invention, is shown. The score card 50 includes the following: indicia for a column of players' names on the far left of the card; fifteen columns for points received during respective rounds to the right of the name column; and a column on the far right for total scores.

In FIG. 9 a special lightweight ball 12 is shown that has a vinyl cover 52 for a crushable, lightweight plastic 54 interior.

The cans 16, 17, and 18 can be made from plastic or metal. The floor of a base unit 20 can be made from plywood, plastic, or metal. The back board portion 24 can be made from metal or plastic. A vinyl edging can be used when the back board portion is made from sheet metal.

Although the embodiments of the invention described above have employed balls 12 as the tossed objects, it is also contemplated that a wide variety of other tossed objects can be employed. For example, the apparatus of the invention can be employed with bean bags and rings, among other tossed objects.

Games employing the apparatus for a ball tossing game of the invention can be used with a wide variety of different protocols. For example, any number of players that wish to play can play. Any suitable number of balls can be used. The game can end when a prescribed point value has been reached by a player; or the game can end after a prescribed number of rounds; and the winner would be the player who accumulated the most points after the prescribed number of rounds have been completed.

In another protocol, a prescribed number of points must be attained exactly and not exceeded. If the prescribed number of points (e.g. twenty-one points) is exceeded, a player would have to go back to sixteen points and approach twenty-one points again. In another protocol, the scoring regimen with the apparatus for a ball tossing game of the invention can be like scoring in the game of horseshoes. Players can play as individuals or on teams.

With any protocol, the game is a lot of fun, and virtually any age can play. The ball 12 can be so light that it is easy to toss without muscle strain, and no one will get hurt if hit by the tossed ball.

With the embodiment of the invention shown in FIG. 5, players don't have to go back and forth between successive rounds. Instead, players would go back and forth after every other round. For example, in a first round, the players would stand near target assembly 14 and toss the balls 12 to target assembly 15. For the second round, the players would stand near target assembly 15 and toss the balls 12 to target assembly 14. For the third round, the players would once again stand near target assembly 14 and toss the balls to target assembly 15.

The novice line 38 and the expert line 40 can be used in a number of different ways. Either the respective target assemblies 14 and 15 can be moved to be near the respective novice and expert lines 38 or 40; or a player can stand at a respective novice or expert line 38 or 40 when tossing a ball 12 at a distant target assembly. Point values can be different with respect to tosses associated with the novice line and tosses associated with the expert line.

Since cans 16 and 17 are easier to score with, these cans can have an assigned point value of 1 and 2, respectively. Since can 18 is more difficult to score with, can 18 can be assigned a point value of 3. Tossed balls 12 could be color coded to correspond with different players.

It is apparent from the above that the present invention accomplishes all of the objects set forth by providing a new and improved apparatus for a ball tossing game that is low in cost, relatively simple in design and operation, and which may advantageously be used by people for fun and with safety.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved apparatus for an object tossing game, comprising:

an object for tossing to a target assembly;

a target assembly for receiving a tossed object, said target assembly including a number of target elements and a base unit for supporting said target elements, further including:

support surface means for supporting said target assembly, a housing, means contained within said housing for rolling up and storing within said housing said support surface means, wherein:

two target assemblies are provided;

said target assembly support surface means includes two flexible sheets, each of said respective flexible sheets for placement thereon of one of said respective two target assemblies; and said support surface rolling up means includes two rolling up assemblies, each of said respective rolling up assemblies adapted for rolling up one of said respective two flexible sheets and storing same within said housing after said respective target assemblies have been removed from said flexible sheets through an opposite side of said housing.

2. The apparatus described in claim 1 wherein said support surface rolling up means includes a coiled spring.

3. The apparatus described in claim 1 wherein said tossed object is a soft, resilient, light-weight ball.

4. The apparatus described in claim 1 wherein:

said target assembly support surface means includes a first member of a hook and pile connector;

said target assembly includes a second member of a hook and pile connector.

5. The apparatus described in claim 4 wherein said target assembly support surface means includes indicia indicating a number of predetermined positions at which said target assembly can be placed on said target assembly support surface means.

6. The apparatus described in claim 5 wherein said predetermined positions of said target assembly on said target assembly support surface means are representative of different levels of difficulty for successfully targeting a target element in said target assembly.

* * * * *